US006402071B1

(12) United States Patent
Gingras

(10) Patent No.: US 6,402,071 B1
(45) Date of Patent: Jun. 11, 2002

(54) REFINER PLATES WITH INJECTOR INLET

(75) Inventor: Luc Gingras, Horsforth (GB)

(73) Assignee: Durametal Corporation, Tualatin, OR (US)

( * ) Notice: Subject to any disclaimer, the term of this patent is extended or adjusted under 35 U.S.C. 154(b) by 0 days.

(21) Appl. No.: 09/453,050

(22) Filed: Nov. 23, 1999

(51) Int. Cl.[7] ..... B02C 7/12

(52) U.S. Cl. ..... 241/261.2; 241/261.3; 241/298

(58) Field of Search ..... 241/261.2, 261.3, 241/298

(56) References Cited

U.S. PATENT DOCUMENTS 5,181,664 A * 1/1993 Kohler ..... 241/261.3
5,934,585 A * 8/1999 Chaney ..... 241/298
6,032,888 A * 3/2000 Deuchars ..... 241/261.3

FOREIGN PATENT DOCUMENTS

WO WO 95/25199 3/1995

* cited by examiner

*Primary Examiner*—Allen Ostrager
*Assistant Examiner*—William Hong
(74) *Attorney, Agent, or Firm*—Alix, Yale & Ristas, LLP

(57) ABSTRACT

A refiner for refining lignocellulosic material having opposed, relatively rotating, rotor and stator refiner plates. The refiner plates each have radially inner and outer edges and an inlet zone extending radially outward from the inner edge. The inlet zone of each refiner plate has a radially inner portion and a radially outer portion. The inner portion of the rotor plate includes a plurality of breaker bars which curve in a direction which is opposite to the direction of rotation of the rotor plate and which extend to a height substantially equal to one-half of the refining gap. The outer portion of the inlet zone of the stator plate has a plurality of dams. Each of the dams has an upper ramp surface extending to an outer end having a curved profile. The outer portion of the inlet zone of the rotor plate and the inner portion of the inlet zone of the stator plate may each have either a smooth surface or a plurality of outwardly extending low profile protrusions.

23 Claims, 5 Drawing Sheets

REFINER PLATES WITH INJECTOR INLET

BACKGROUND OF THE INVENTION

The present invention relates generally to disc grinders for lignocellulosic material. More particularly, the present invention relates to refiner plate segments for such an apparatus.

In high consistency mechanical pulp refiners, the wood fibers are worked between two relatively rotating discs on which refiner plates are mounted. The plates usually have radial bars and grooves. The bars provide impacts or pressure pulses which separate and fibrillate the fibers and the grooves enable feeding of the fibers between the refiner discs. Typically, each refiner plate has a radially inner inlet zone which is adapted for receiving wood chips, previously refined fiber, or the like and at least one radially outer refining zone. The inlet zone performs an initial refining operation thereon to reduce the size of the material, feeds the incoming material into the refining zone and distributes the material around the whole circumference of the refining zone. In most conventional refiners, the inlet zone of the refiner plates either feeds well or distributes well, but rarely achieves both goals effectively.

A large volume of steam is produced between the refiner plates as a result of the refining work. The majority of this steam is exhausted from between the refiner plates via the grooves. However, flow restrictions due to a small plate gap and fiber-filled grooves result in a steam pressure peak between the plates, located radially inward from the perimeter. This pressure peak is a major source of the refining thrust load, and can induce control instability at high motor loads. It is thus desirable that the steam generated during refining be discharged from the refining region as quickly as possible, while retaining the pulp within the region as long as possible.

Since the peak pressure zone is located between the inner and outer radial ends of the refiner plates, the steam is exhausted radially outward and inward from the peak pressure zone via the grooves. The back flow of steam toward the inlet zone of the refiner plate can interfere with the feed of material into the refiner. This generally results in an unstable refiner load and a reduction in pulp quality. The back flow of steam can also carry-over fibrous material into the upstream heat recovery unit. This may result in plugging of the heat recovery unit. The back flow steam may also be lost to the system, resulting in energy losses.

SUMMARY OF THE INVENTION

Briefly stated, the invention in a preferred form is a pair of relatively rotating, opposed refiner plates for refining lignocellulosic material. The refiner plates each have radially inner and outer edges and an inlet zone extending radially outward from the inner edge. The inlet zone of the first refiner plate, which is rotatable in a direction of rotation, has a radially inner portion and a radially outer portion. The inner portion includes a plurality of curved breaker bars. Each of the breaker bars curves in a direction which is opposite to the direction of rotation from an inner end disposed adjacent the inner edge of the first refiner plate to an outer end disposed adjacent the outer portion.

Each of the breaker bars has a leading edge having a feeding angle $\alpha$ at any given point therealong. The feeding angle $\alpha$ is defined by the angle between the leading edge at the given point and a radial line passing through the point. The feeding angle $\alpha_1$ at a point adjacent the front end of the breaker bar has a value between 0° and 30°. The feeding angle $\alpha_2$ at a point adjacent the outer end has a value between 60° and 90°. Each of the breaker bars has a top surface defining a height substantially equal to one-half of the refining gap formed between the opposed refiner plates.

The inlet zone has an arc length $\lambda_S$ and each of the breaker bars has an arc length $\lambda_B$. The sum of the arc lengths of the breaker bars is at least 50% of the arc length of the inlet zone, preferaby between 60% to 100% of the arc length of the inlet zone, and more preferably between 60% to 80% of the arc length of the inlet zone.

In a first embodiment, the outer portion of the inlet zone of the first refiner plate has a smooth surface. In a second embodiment, the outer portion of the inlet zone of the first refiner plate has a plurality of outwardly extending low profile protrusions.

The inlet zone of the second refiner plate also has radially inner and outer portions which are disposed oppositely to the inner and outer portions of the first refiner plate. The outer portion of the inlet zone of the second refiner plate has a plurality of dams. Each of the dams has an upper ramp surface extending radially outward from an inner end to a head disposed adjacent an outer end. The outer end of each dam has a curved profile. The ramp surface may be either curved or flat. The inner portion of the inlet zone of the second refiner plate may have either a smooth surface or a plurality of outwardly extending, low profile protrusions.

It is an object of the invention to provide a refiner for refining lignocellulosic material having new and improved rotor and stator plates.

It is also an object of the invention to provide new and improved rotor and stator plates in which the stator plate directs back flowing steam and material onto the rotor plate which restricts the back flow of material and pumps the back flow of steam forward.

Other objects and advantages of the invention will become apparent from the drawings and specification.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
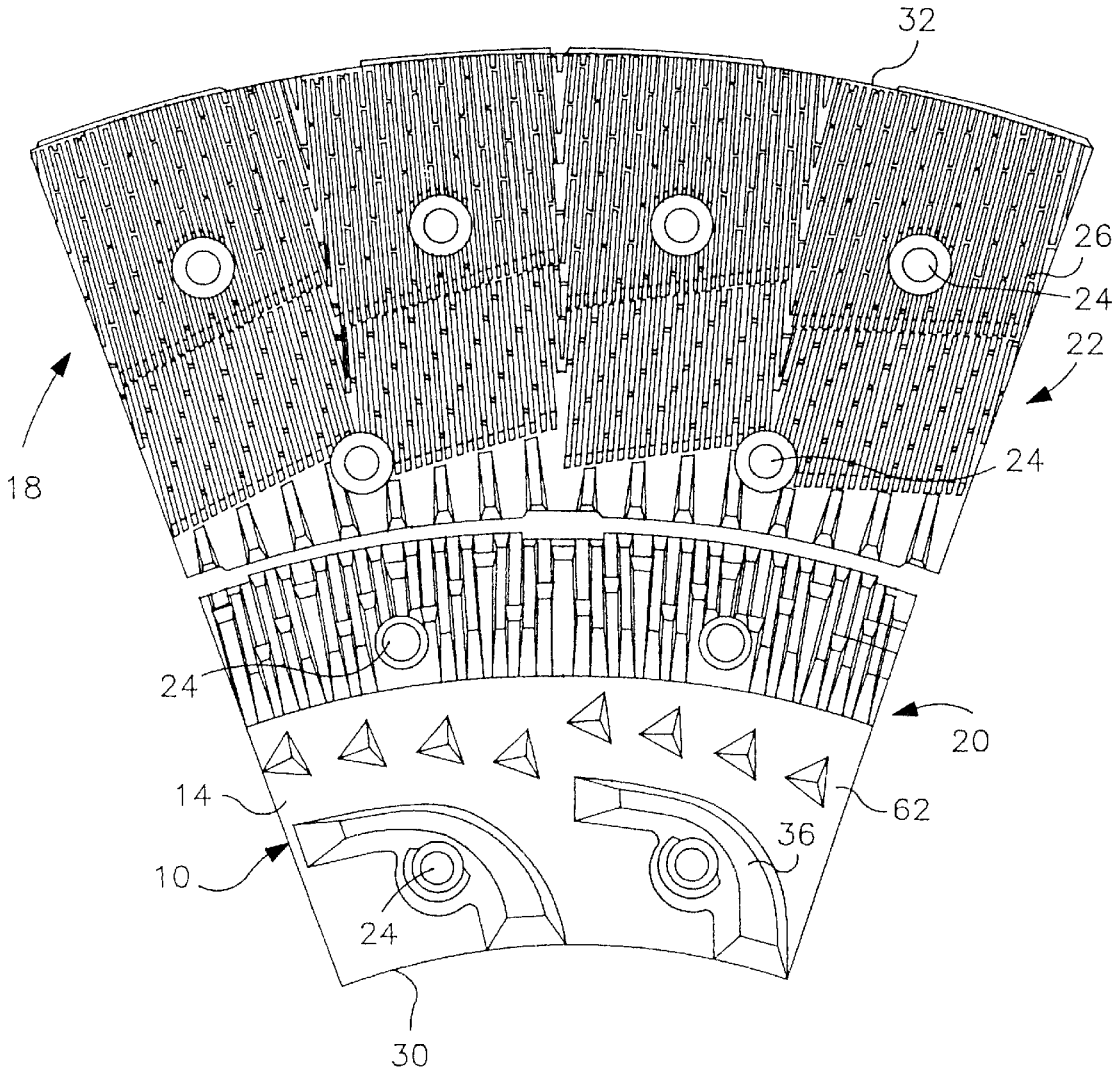
FIG. 1 is an elevational view of a portion of a rotor plate including a first embodiment of a rotor plate segment having an inlet zone in accordance with the invention.

With reference to the drawings wherein like numerals represent like parts throughout the several figures, an injector inlet zone for a rotor plate segment 14, 14' and an injector inlet zone for a stator plate segment 16 in accordance with the present invention are generally designated by the numerals 10, 10' and 12, respectively. The rotor plate 18 and stator plate (not shown) each include a plurality of plate segments 14, 14', 16 which are securable to the front face of a substantially circular refiner disc (not shown).

The rotor plate 18 illustrated in FIG. 1 has two concentric rings of refiner plate segments, an "inner" or "center" ring 20 and an "outer" or "peripheral" ring 22. Generally, the stator plate in this type of refiner also has concentric inner and outer rings. Other types of refiner use only one ring of refiner plates per disc, or even have a conical outer section. The subject inlet zone 10, 12 can be applied to the inner rings of a multiple, concentric ring refiner or to the inner portions of a single ring refiner. In refiners using two or more rings per disc, it should be understood that the position of each feature described below may appear at various locations on the rings, depending on the geometry of the rings.

Figure 5:
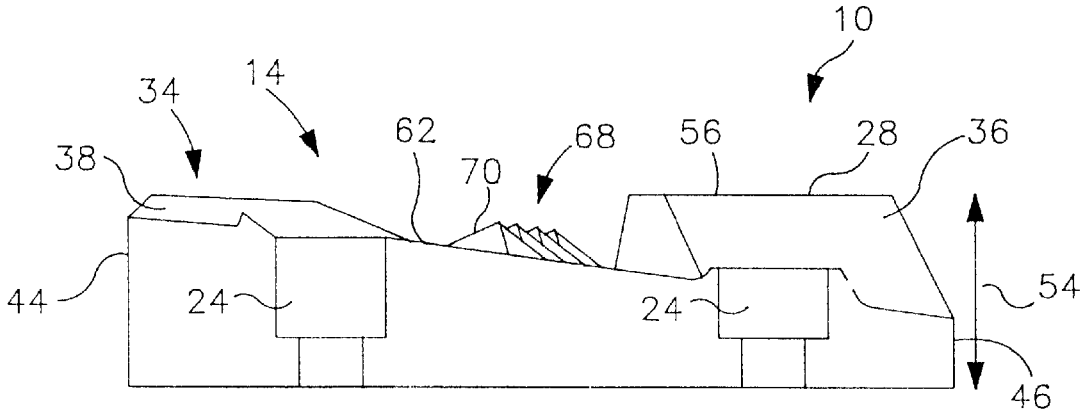
FIG. 5 is a cross-sectional view taken along line 5—5 of FIG. 2.
Figure 6:
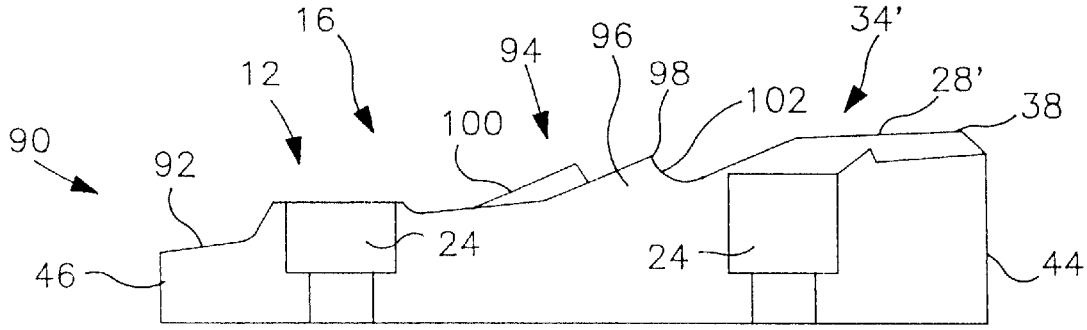
FIG. 6 is a cross-sectional view taken along line 6—6 of FIG. 3.

The plate segments 14, 14', 16, 26 are attached to the disc face, in any convenient or conventional manner, such as by bolts (not shown) passing through bores 24. One end of the bolt engages the disc and at the other end has head structure bearing against a countersunk surface. The disc has a center about which the disc rotates, and a substantially circular periphery. The inner and outer plate segments 14, 14', 16, 26 are arranged side-by-side on the face of the respective disc, to form a substantially annular refiner face, shown generally at 28, 28' (FIGS. 5, 6). The face 28 of the rotor plate segment 14, 14' when confronting the face 28' of the opposed stator plate segment 16 define a refiner gap and form a portion of a refiner region.

Each rotor plate 18 and each stator plate has an inner edge 30 near the center of the disc and an outer edge 32 near the periphery of the disc. Since the discs and plates rotate, the partially refined material is directed, as a result of centrifugal force, radially outward. Substantial quantities of steam are also generated in the preliminary refining zone 34, 34' of the inner refiner segments 14, 16 and the outer ring 22, producing a steam flow with high radial velocity. Especially with relatively large discs, the centrifugal forces acting on the steam and partially refined chips increase dramatically as the material moves farther and farther radially outward. Although it is highly desirable that the steam be quickly exhausted from the refining region, it is essential that the partially refined fibers not be prematurely exhausted along with the steam. This condition is influenced by the radial pressure profile along the refiner face 28, 28' due to steam generated by the refining at high consistency. Since the pressure peak is between the inner and outer edges 30, 32 of the plate, the steam flows forward (radially outward) from the outer side of the pressure peak and backward (radially inward) inside the pressure peak, against the material feed.

The back flow of steam toward the inner edge 30 of the refiner plates can interfere with the feed of material into the refiner. This can result in an unstable refiner load, a reduction in pulp quality, and a carry-over of fibrous material into the upstream heat recovery unit with a resultant plugging of the heat recovery unit. Inlet zones 10, 12 in accordance with the subject invention help pump the steam forward against the back-flowing steam and restrict the flow of material in the back-flowing steam. In addition, such inlet zones 10, 12 provide improved optimization of the feeding and distribution effects.

The remainder of this description will refer to single inner rotor and stator plate segments 14, 14', 16, but it should be understood that all the inner segments 14, 14', 16 which define each inner ring 20, are preferably substantially similar. It should also be understood that in refiners having only a single ring of refiner plates or a conical outer section, each of the refiner plate segments are substantially similar.

In the first embodiment (FIGS. 2 and 5), each inner ring rotor plate segment 14 includes a first or inlet zone 10 and a second or preliminary refining zone 34. The inlet and preliminary refining zones 10, 34 each have a multiplicity of bars 36, 38 and grooves 40, 42 between adjacent bars. The bars 38 and grooves 42 of the preliminary refining zone 34 extend in parallel, substantially radially. Each zone 10, 34 may comprise a plurality of fields, where each field has a uniform pattern. The inlet zone 10 and preliminary refining zone 34 are especially adapted for receiving wood chips, wood pulp, or the like and performing an initial refining operation thereon to reduce the size of the material and funnel it radially outward into the refining zones of the outer ring 22. The patterns promote the flow of steam radially outward to the outer edge 44 of the plate segment 14 while retarding the flow of material to ensure that the material is initially refined. In the second embodiment (FIG. 4), the inner ring plate segment 14' does not include a preliminary refining zone. Instead, the inlet zone 10' directs the material to the outer ring 22 for refining.

Figure 2:
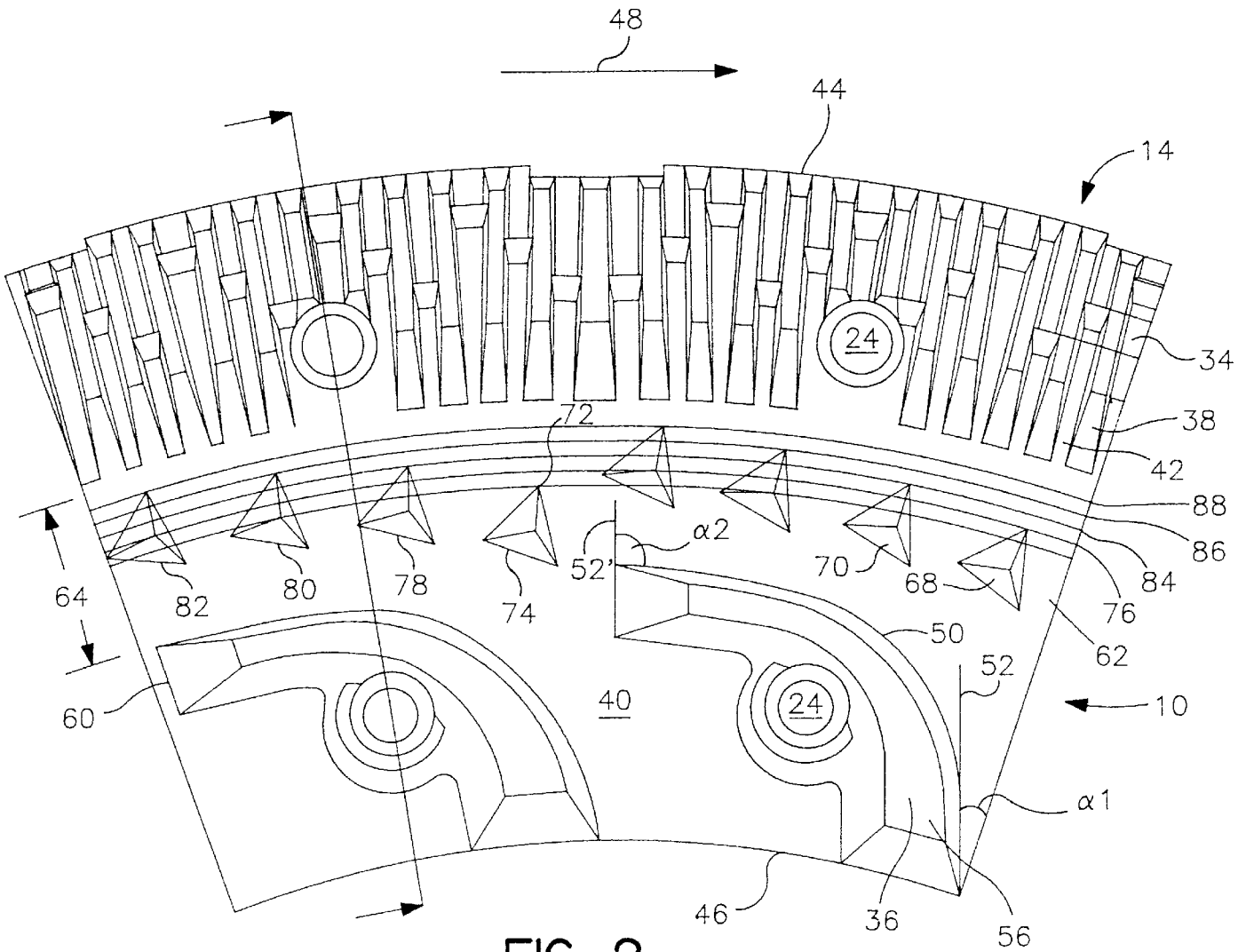
FIG. 2 is an enlarged elevational view of the rotor plate segment of FIG. 1.
Figure 4:
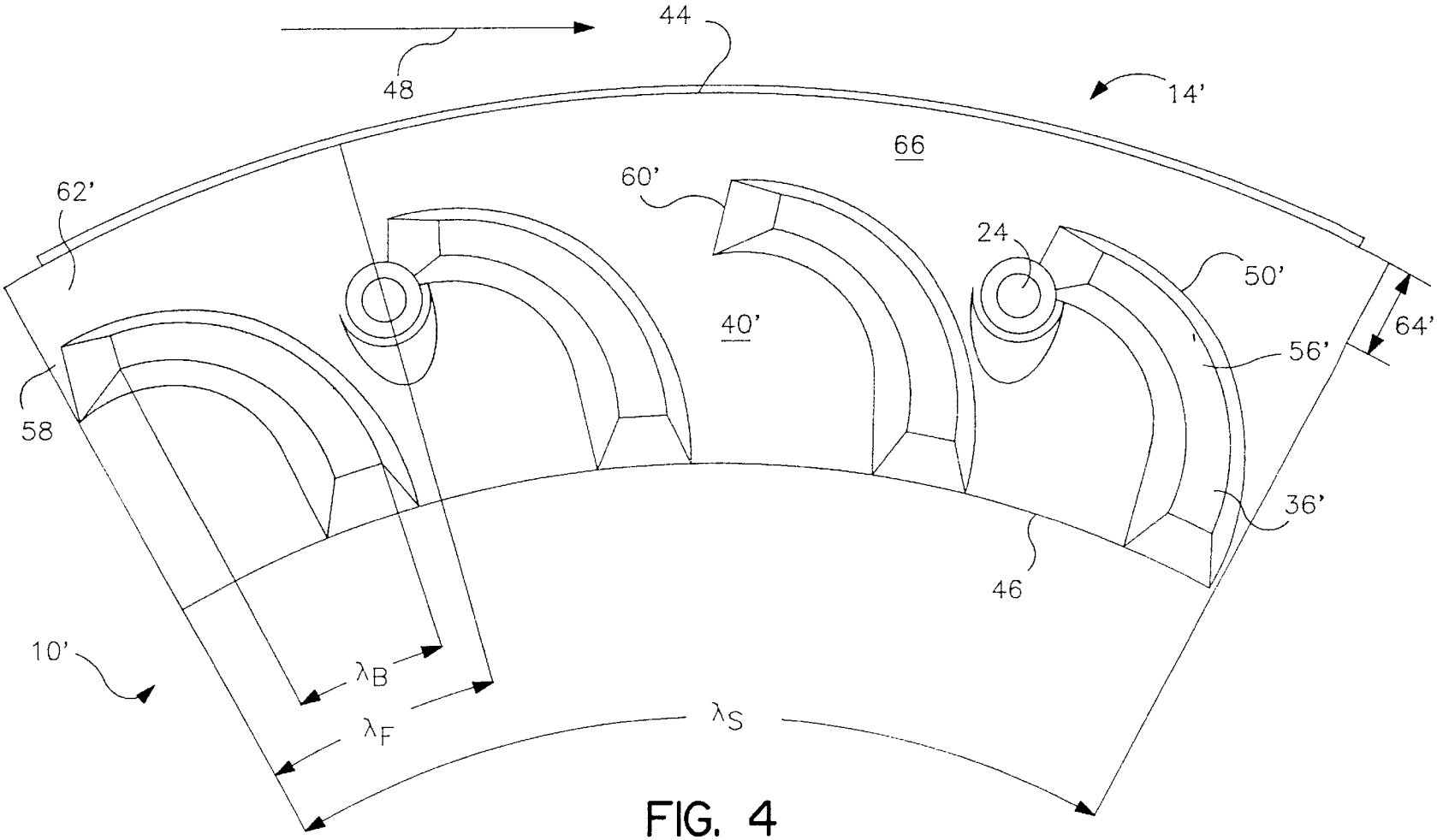
FIG. 4 is an elevational view of a second embodiment of a rotor plate segment having an inlet zone in accordance with the invention.

With reference to FIGS. 2, 4 and 5, the inlet zone 10, 10' of a rotor plate segment 14, 14' in accordance with the invention includes curved breaker bars 36, 36' which extend radially outward from the inner edge 46 of the plate segment 14, 14' toward the outer edge 44 of the plate segment 14, 14'. The breaker bars 36, 36' curve in a direction that is opposite to the direction of rotation, shown by arrow 48, to provide a feeding effect. The feeding angle $\alpha$, defined as the angle of the leading edge 50, 50' of the breaker bar 36, 36' at any point along the length of the breaker bar 36, 36' relative to a radial line 52, 52' passing through that point, increases as the point of measurement moves away from the inner edge 46 of the plate. The curve in the breaker bar 36, 36' should be such that the feeding angle $\alpha_1$ at the inlet is between 0° and 30°. At the opposite end of the breaker bar 36, 36', the angle $\alpha_2$ is between 60° and 90°. Preferably, the height 54 of the breaker bars 36, 36' is such that the top surface 56, 56' of each breaker bar 36, 36' is substantially adjacent the centerline of the plate gap between the rotor and stator plates. In other words the height 54 of the breaker bars 36, 36' is preferably one-half of the width of the refiner gap. The feeding angle $\alpha$ and the height 54 are selected depending on the type of refiner, the material to be refined, the feeding intensity required, and the amount of steam to be handled. Consequently, the breaker bars 36, 36' may have a height 54 which is greater than one-half of the refiner gap width or less than such width, depending on the application.

The curved breaker bars 36, 36' should cover at least fifty percent (50%) of the arc length $\lambda_S$ of the inlet zone 10, 10', preferably between sixty and one-hundred percent (60–100%), and even more preferably between sixty and eighty percent (60–80%) in order to maximize the feeding ability and to block the back flowing steam and the fibrous material carried in the back flowing steam. For the rotor plate segment 14' illustrated in FIG. 4, the arc length $\lambda_B$ of each breaker bar 36' has a value substantially equal to 10° and the arc length $\lambda_F$ of the portion of the field 58 in which the breaker bar 36' is positioned has a value substantially equal to 15°. Therefore, the breaker bar 36' covers 67% (10°/15°) of the arc length $\lambda_F$ of the portion of the field 58 in which it is positioned. Viewing the rotor plate segment 14' as a whole, the four breaker bars 36' positioned thereon cover 67% (4×10°/60°) of the total arc length $\lambda_S$ of the segment 14'. Test results conducted with a limited number of rotor plate segments 14, 14' indicate that optimum performance occurs when $0.6\times\lambda_S<N\times\lambda_B<\lambda_S$, where N equals the number of breaker bars 36, 36'.

With this profile, the breaker bars 36, 36' not only maximize the feeding effect of the incoming material at the inlet, but also allow the feed material to slip around the outer end 60, 60' of the breaker bars 36, 36', where the feeding angle $\alpha_2$ is substantially tangential to the radial line 52'. This improves the distribution of the feed around the outer periphery of the rotor plate 18. As the curved breaker bars 36, 36' cover a substantial distance tangentially around the rotor plate 18, they prevent material flowing back with the steam.

The inlet zone 10, 10' also includes a slippage area 62, 62' disposed radially outward from the area containing the curved breaker bars 36, 36'. The slippage area 62, 62' of each rotor plate segment 14, 14' form a ring that surrounds the breaker bars 36, 36' in the assembled rotor plate 18. The width 64, 64' of the slippage area 62, 62' is at least one-quarter (¼) of an inch, preferably one (1) inch. The slippage area 62, 62' allows the feed material to be properly distributed before it enters the preliminary refining zone 34, 34' or the outer ring 22.

The slippage area 62, 62' may either have a smooth surface 66 (FIG. 4) or include low profile restrictions 68 (FIGS. 1 and 2) such as ramps or dams of various shapes, sizes and orientations. These restrictions 68 may be located along the curved breaker bars 36 and/or in the slippage area 62 outside the curved breaker bars 36. The restrictions 68 further enable the feed material to be distributed by forcing some of it to move toward the opposing stator plate and be re-distributed back into the rotor plate 18, as well as deflecting some of the material into different areas of the preliminary refining zone 34, 34'

In the embodiment shown in FIGS. 1 and 2, the restrictions 68 are composed of a plurality of pyramid-shaped protrusions 70. Preferably, the protrusions 70 are positioned in substantially identical groups of four radially and axially spaced protrusions 70. The radially outermost corner 72 of the first protrusion 74 in each group (in the direction of rotation) falls on a circle 76 which is coaxial with the axis of rotation of the rotor plate 18. Similarly, the radially outermost corners 72 of the second, third, and fourth protrusions 78, 80, 82 in each group fall on concentric coaxial circles 84, 86, 88 where the radius of the circle for protrusion n is greater than the radius of the circle n-1. In other words, the radius of the circle 76 for the first protrusion 74 is less than the radius of the circle 84 for the second protrusion 78, which is less than the radius of the circle 86 for the third protrusion 80, which in turn is less than the radius of the circle 88 for the fourth protrusion 82.

Figure 3:
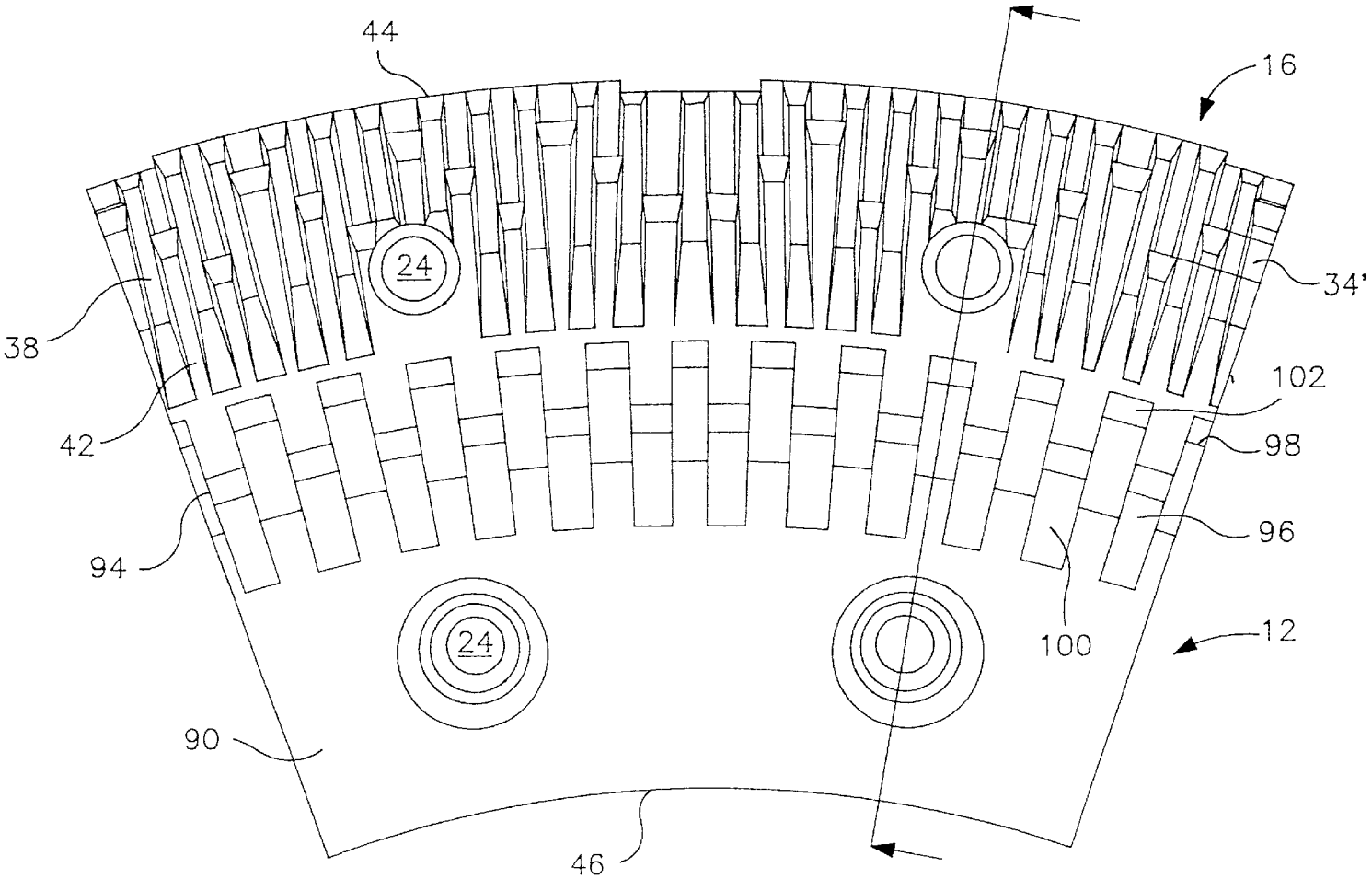
FIG. 3 is an elevational view of a stator plate segment having an inlet zone in accordance with the invention.

With reference to FIGS. 3 and 6, the inlet zone 12 of the stator plate segment 16 preferably includes an inner portion 90 having a smooth surface 92 that is disposed opposite to the curved breaker bars 36, 36' of the rotor plate segment 14, 14' in the assembled refiner. The smooth surface 92 maximizes the feeding effect of the stator plate. Alternatively, the inner portion 90 may include a low profile pattern of protrusions (not shown) such as bars and/or dams to help control the feed of the material.

Inlet zone 12 also includes a radially outer portion 94 which is disposed opposite to the slippage area 62, 62' of the rotor plate segment 14, 14' in the assembled refiner. Outer portion 94 includes only dams 96, instead of the bars and grooves that are found in conventional stator plates. The dams 96 cover at least the equivalent of the slippage area 62, 62' of the rotor disc, but may also extend further radially inward and outward. The dams 96 are positioned around the stator plate such that the dam heads 98 are exposed and also prevent the rotation of material around the stator plate. The dams 96 are also juxtaposed, forcing all the steam to hit at least one dam 96 when travailing towards the inner edge 46 of the stator plate.

Preferably, the dams 96 are shaped with a long ramp 100 at the inner end. The ramp 100 may have either a flat or curved upper surface. The radially outer back 102 of the dam 96 has a curved profile, starting parallel to the profile of the base plate and ending close to ninety degrees (90°) at the dam head 98. This profile will force a turbulent action in the steam such that the back flowing steam and fibrous material carried in the back flowing steam are forced back onto the rotor plate 18. This action significantly reduces the amount of fiber carried over with the back-flowing steam, as the feeding effect of the rotor will take control of this material and feed it forward.

It should be appreciated any type of bar and groove pattern may be utilized in the preliminary refining zone 34, 34' of either plate. It should also be appreciated that the subject invention may also be used in double-disc refiners, where two rotor plates rotate in opposite directions. In such a case, only one of the rotor plates, preferably the feed end rotor, would be equipped with the above-described rotor inlet zone 10, 10', while the other rotor plate would use an inlet zone 12 similar to that described above for the stator plate. It should further be appreciated that the subject invention may be used in conical-disc refiners, where a conical refining zone follows a flat refining zone, and in conical refiners.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A refiner for refining lignocellulosic material comprising first and second, relatively rotating, opposed refiner plates, the plates defining a refining gap disposed therebetween, the first refiner plate being rotatable in a direction of rotation, each of the refiner plates having radially inner and outer edges and an inlet zone extending radially outward from the inner edge, the inlet zone of the first refiner plate having radially inner and outer portions, the inner portion including a plurality of curved breaker bars, each of the breaker bars having an inner end disposed adjacent the inner edge, an outer end disposed adjacent the outer portion, and a leading edge extending from the inner end to the outer end, each of the breaker bars curving in a direction which is opposite to the direction of rotation from the inner end to the outer end, the leading edge having a feeding angle $\alpha$ at any given point along the leading edge, the feeding angle $\alpha$ being defined by the angle between the leading edge at a given point and a radial line passing through the point, a feeding angle $\alpha_1$ at a point adjacent the front end of the breaker bar having a value between 0° and 30° and a feeding angle $\alpha_2$ at a point adjacent the outer end having a value between 60° and 90°.

2. The refiner of claim 1 wherein each of the breaker bars has a top surface defining a height substantially equal to one-half of the refining gap.

3. The refiner of claim 1 wherein the inlet zone has an arc length $\lambda_S$ and each of the breaker bars has an arc length $\lambda_B$, the sum of the arc lengths of the breaker bars being at least 50% of the arc length of the inlet zone.

4. The refiner of claim 3 wherein the sum of the arc lengths of the breaker bars is between 60% to 100% of the arc length of the inlet zone.

5. The refiner of claim 3 wherein the sum of the arc lengths of the breaker bars is between 60% to 80% of the arc length of the inlet zone.

6. The refiner of claim 1 wherein the outer portion of the inlet zone of the first refiner plate has a smooth surface.

7. The refiner of claim 1 wherein the outer portion of the inlet zone of the first refiner plate includes a plurality of outwardly extending protrusions, each of the protrusions having a low profile.

8. The refiner of claim 1 wherein the inlet zone of the second refiner plate has radially inner and outer portions, the radially inner and outer portions of the second refiner plate being disposed substantially opposed to the inner and outer portions of the first refiner plate, the outer portion of the inlet zone of the second refiner plate having a plurality of dams.

9. The refiner of claim 8 wherein each of the dams has an upper ramp surface extending radially outward from an inner end to a head disposed adjacent an outer end, the outer end having a curved profile.

10. The refiner of claim 9 wherein the ramp surface has a curved surface.

11. The refiner of claim 9 wherein the ramp surface has a flat surface.

12. The refiner of claim 8 wherein the inner portion of the inlet zone of the second refiner plate has a smooth surface.

13. The refiner of claim 8 wherein the inner portion of the inlet zone of the second refiner plate includes a plurality of outwardly extending protrusions, each of the protrusions having a low profile.

14. A segment for a refiner rotor plate rotatable in a direction of rotation, the segment comprising:

radially inner and outer edges and an inlet zone extending radially outward from the inner edge, the inlet zone including a radially inner portion having a plurality of curved breaker bars, each of the breaker bars curving in a direction which is opposite to the direction of rotation from an inner end disposed adjacent the inner edge to an outer end disposed adjacent the outer portion, each of the breaker bars having a leading edge, the leading edge having a feeding angle $\alpha$ at any given point along the leading edge, the feeding angle $\alpha$ being defined by the angle between the leading edge at a given point and a radial line passing through the point, the feeding angle $\alpha_1$ at a point adjacent the front end of the breaker bar having a value between 0° and 30° and the feeding angle $\alpha_2$ at a point adjacent the outer end having a value between 60° and 90°.

15. The segment of claim 14 wherein the inlet zone further comprises a radially outer portion having a plurality of outwardly extending protrusions, each of the protrusions having a low profile.

16. The segment of claim 14 wherein each of the breaker bars has a top surface defining a height substantially equal to one-half of the refining gap.

17. The segment of claim 14 wherein the inlet zone has an arc length $\lambda_S$ and each of the breaker bars has an arc length $\lambda_B$ the sum of the arc lengths of the breaker bars being at least 50% of the arc length of the inlet zone.

18. The segment of claim 14 wherein the inlet zone has an arc length $\lambda_S$ and each of the breaker bars has an arc length $\lambda_B$, the sum of the arc lengths of the breaker bars being between 60% to 100% of the arc length of the inlet zone.

19. The segment of claim 14 wherein the inlet zone has an arc length $\lambda_S$ and each of the breaker bars has an arc length $\lambda_B$, the sum of the arc lengths of the breaker bars being between 60% to 80% of the arc length of the inlet zone.

20. The segment of claim 14 wherein the inlet zone further comprises a radially outer portion having a substantially smooth surface.

21. A segment for a refiner stator plate comprising:

radially inner and outer edges;

a refining zone extending radially inward from the outer edge having a plurality of substantially radially disposed bars and a plurality of grooves alternating with the bars; and an inlet zone extending radially outward from the inner edge to the refining zone, the inlet zone having no bars or grooves, the inlet zone including a radially inner portion having a substantially smooth surface and a radially outer portion having a plurality of outwardly extending dams.

22. The refiner of claim 21 wherein each of the dams has an upper ramp surface extending radially outward from an inner end to a head disposed adjacent an outer end.

23. The refiner of claim 21 wherein the outer end of the dam has a curved profile.

* * * * *